United States Patent [19]

Rosewicz et al.

[11] 4,029,023

[45] June 14, 1977

[54] FOUR-WAY PALLET

[75] Inventors: Horst Rosewicz; Werner Klein, both of Ludwigshafen, Germany

[73] Assignee: Furnier- und Sperrholzwerk Werzalit-Pressholzwerk J. F. Werz Jr. KG, Oberstenfeld, Germany

[22] Filed: Feb. 24, 1976

[21] Appl. No.: 661,027

[30] Foreign Application Priority Data

Aug. 20, 1975 Germany ..... 2440242

[52] U.S. Cl. ..... 108/51.1; 108/53.3; 108/901; 104/135

[51] Int. Cl.[2] ..... B65D 19/24

[58] Field of Search ..... 108/51.1, 52, 53.1, 108/53.3, 55.1, 55.3, 55.5, 56.1, 57; 206/386; 217/43 A; 193/35 R; 104/135

[56] References Cited

UNITED STATES PATENTS

| | | | |
|---|---|---|---|
| 2,615,661 | 10/1952 | Cushman | 108/53.3 |
| 3,167,341 | 1/1965 | Higgins | 108/53.3 X |
| 3,424,110 | 1/1969 | Toot | 108/901 X |
| 3,707,929 | 1/1973 | Lauffer | 108/901 X |
| 3,880,092 | 4/1975 | Seeber et al. | 108/51.1 |
| 3,915,098 | 10/1975 | Nania | 108/51.1 |

FOREIGN PATENTS OR APPLICATIONS

| | | | |
|---|---|---|---|
| 931,539 | 7/1963 | United Kingdom | 108/51.1 |
| 838,477 | 6/1960 | United Kingdom | 108/901 |

*Primary Examiner*—Roy D. Frazier
*Assistant Examiner*—William E. Lyddane
*Attorney, Agent, or Firm*—Michael J. Striker

[57] ABSTRACT

A four-way pallet is of rectangular shape and is unitarily formed inwardly of each of its longitudinal edges with a row of three edge bosses projecting and tapering from one of the faces of the pallet. These bosses constitute feet for the pallet and define a pair of parallel ways across the plate at the one face and perpendicular to the longitudinal edges of the pallet. The plate is further formed between and parallel to the edge rows with a row of two middle bosses projecting and tapering from the one pallet face and each formed with apertures in line with the ways. Thus tines of a lift fork can pass under the pallet standing on the bosses between the edge bosses and through the apertures of the middle bosses. Such an arrangement of staggered bosses on the pallet provides continuous support therefor when rolling on a roller-type conveyor in a direction parallel to the longitudinal edges. The pallet is of uniform thickness throughout and the feet have flat faces and sides formed as isosceles trapezoids.

10 Claims, 3 Drawing Figures

FOUR-WAY PALLET

BACKGROUND OF THE INVENTION

The present invention relates to a four-way pallet. More particularly this invention concerns such a pallet made unitarily of a single molded and structured plate.

A four-way pallet of the above-described general type is known which is formed with nine bosses constituting feet and arranged in three parallel rows. These rows define two pairs of mutually perpendicular ways underneath the pallet so that the tines of a lift truck or the like can pass between them from all four sides and lift the pallet and its load. Such pallets have shown themselves to be considerably better than the well-known wooden four-way pallet, as the wooden slats of such a pallet frequently damage the goods on the pallet. Furthermore such pallets, which are usually made of a single structured and molded plate of substantially uniform thickness can be nested one within the other so that they can be stored in a very reduced area, whereas the wooden pallets cannot be nested at all. In addition such pallets are normally formed with edges that act as good protection for the lowest layer of a load of sacks carried on the pallet.

Such pallets nonetheless have the disadvantages that their edges are excessively weak and are frequently damaged in handling. A damaged portion frequently leads to breaking of the entire pallet into several pieces when it is lifted. Another considerable problem is that the feet or bosses on which the pallet is adapted to stand constitute a relatively limited surface area. Thus it is almost never possible to stack one pallet directly on top of another loaded pallet. For such a stacking it is necessary to put a rigid board, normally a square or rectangle of heavy plywood, on top of the lower load so that a pallet can be set on top of it. Thus it is necessary in such warehousing systems to provide a supply of such plywood plates, approximately one for each pallet. This considerably increases the stacking time and also increases costs.

It has been suggested to overcome some of these problems by forming the pallet with three parallel ridges acting as feet and forming between them two rows accessible from two opposite sides of the pallet. Access from the other two sides is made possible by cutting out the ridges along two ways so that the tines of the fork lift can poke through the aligned apertures at right angles to the ridges and lift the pallet. Such a system has the advantage of considerable rigidity in at least one direction and is, unlike the above-described type, able to move along a roller-type conveyor. Nonetheless the provision of such large ridges makes it essential to provide another flat board on top of the pallet when a load of bag material or the like is to be carried on the pallet, as the considerable depressions constituted by these ridges in the top often allow the bags to hang down where they can be pierced by the tines or simply break spontaneously.

SUMMARY OF THE INVENTION

It is therefore an object of the present invention to provide an improved four-way pallet.

Another object is the provision of such a pallet which can move along a roller-type conveyor without catching between the rollers thereof.

Yet another object is to provide such a pallet whose feet have enough supporting surface area to allow a loaded pallet to be stacked on top another load on a pallet, but wherein openings formed in the top of the pallet are not sufficiently large to allow the load to hang through and bags, for instance, to rupture.

These objects are attained according to the present invention in a four-way pallet constitutes as a generally rectangular unitary plate having two pairs of opposite edges and two opposite faces. The plate is unitarily formed along each edge of one of the pairs with a row of three edge bosses projecting and tapering from one of the faces. These bosses constitute feet for the plates and define a pair of parallel ways across the plate at the one face and inset from and perpendicular to the edges of the other pair. The plate is further unitarily formed between and parallel to these rows with a middle row of two middle bosses projecting and tapering from the one face and each formed with apertures in line with the ways. Thus tines of a lift fork can pass under the pallet standing on the bosses in one direction between the edge bosses and through the apertures of the middle bosses and in another direction perpendicular thereto between the rows of bosses.

According to this invention the plate is of generally uniform thickness at and between the bosses and the bosses all have flat portions parallel to the one face and lying in a common plane. The apertures of each middle boss therefore define a passage through the respective middle boss, which passage extends parallel to the plate.

According to other features of this invention the middle bosses are offset relative to the edge bosses in a direction parallel to the rows. Such an arrangement can readily roll along a roller-type conveyor, as the staggered bosses provide a support surface that remains in contact with the rollers at at least four different locations at all times. Furthermore this offsetting of the feet relative to one another protects the middle feet from being stabbed by the tines of the lift fork, as these tines must be carefully positioned between the edge feet before they can reach under the pallet sufficiently far to engage the middle feet and, once properly aligned with the ways defined between the edge feet, these tines will pass neatly through the apertures of the middle feet.

With the system according to the present invention it is also possible to lift the pallet easily by means of a manually operated truck which can engage with its wide fork from the narrow side of the pallet. In this case the tines of the narrow fork will engage to either side of the middle feet. Furthermore with this arrangement the overall surface area of the feet is relatively large compared to the area of the pallet so that it is quite possible to stack one loaded pallet on top of another load on a pallet without damage to the underlying load. Nonetheless the overall sizes of no one boss is so great that a weak package, such as a thin paper sack, is liable to be damaged by resting on top of it and drooping into it.

In accordance with further features of this invention the long edges of pallet, at least, are reinforced. This may be effected by imbedding in these longitudinal edges wooden slats.

According to yet another feature of the present invention the plate constituting the pallet is formed of wood-chip material, by which is meant a mass of wood chips mixed with a usually synthetic-resin binder so that the pallet can be molded in one integral piece. Furthermore the pallet is formed between the bosses with a row of small reinforcing ribs running parallel to each other parallel to the rows of bosses. Further diagonally extending reinforcing ribs are also formed projecting inwardly from the corners of the pallet. All of these ribs are of substantially smaller cross-sectional area than any of the bosses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
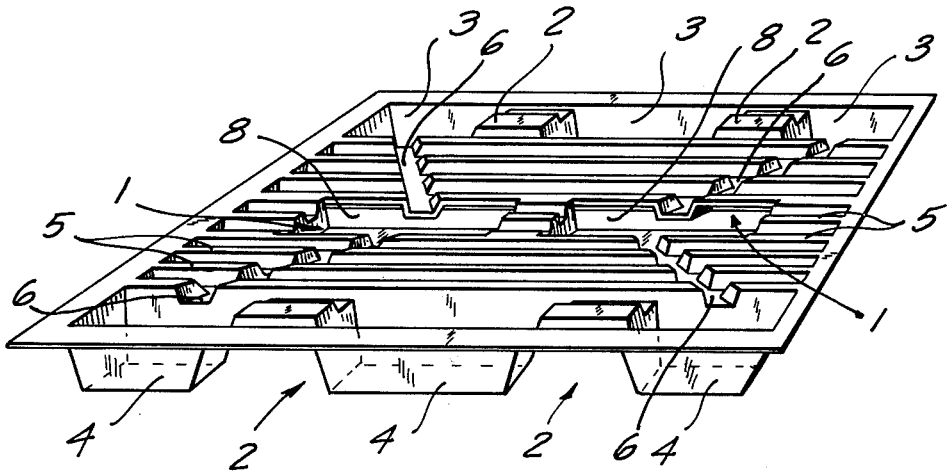
FIG. 1 is a perspective view of the pallet according to the present invention.
Figure 2:
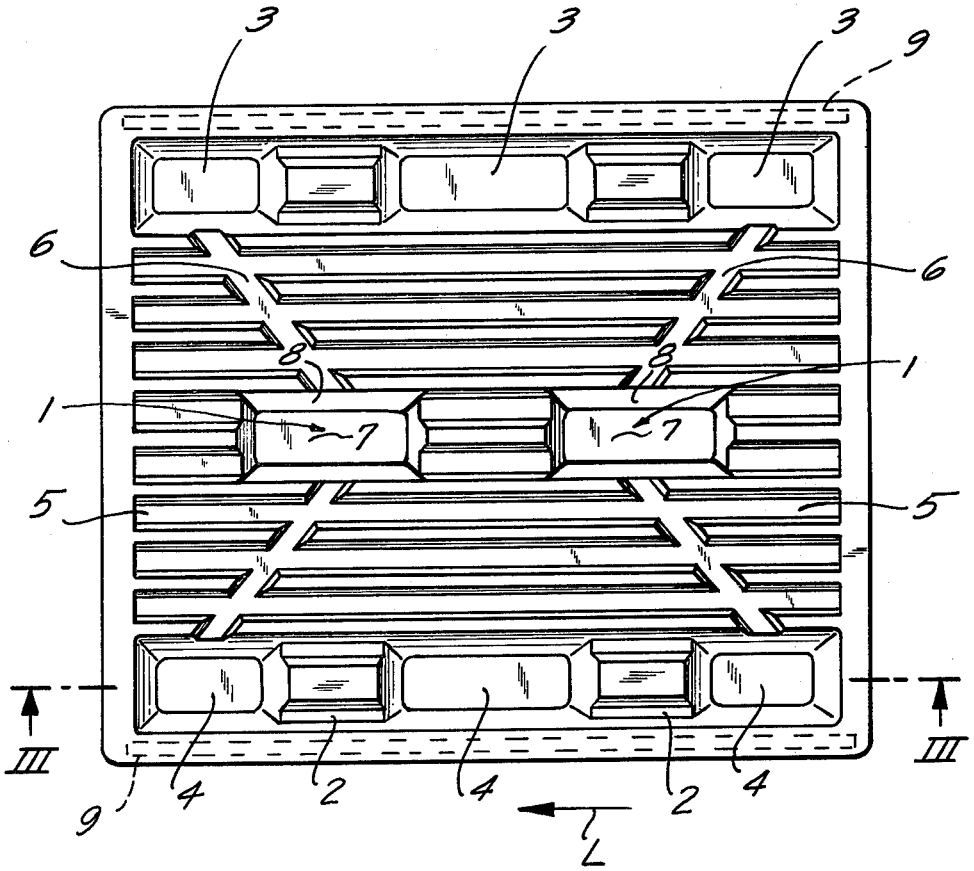
FIG. 2 is a top view of the pallet of FIG. 1.
Figure 3:
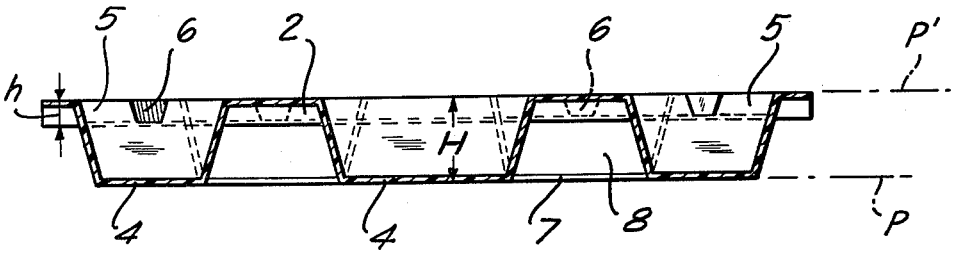
FIG. 3 is a section taken along line III—III of FIG. 2.

The pallet shown in FIGS. 1–3 is rectangular, elongated in the direction of arrow L of FIG. 2. This pallet is unitarily formed of a single molded and structured plate of wood-chip material. It is formed along each of its longitudinally-extending edges with a row of three bosses or feet 3 having generally rectangular bottom portions 4 all lying in a common plane P parallel to another plane P′ defined by the upper surface of the pallet on which a load of goods is to rest. The central foot 3 in each of the rows is slightly longer than the other two feet, and the feet 3 define a pair of ways 2 across the pallet.

In the middle the pallet is formed with two feet 1 having bases 7 cut out on their longitudinal sides to form apertures 8 in line with the ways 2. FIG. 3 shows how this forms passages of isosceles trapezoidal shape through the pallet, since the bases 7 of the feet 1 are of the same length as the gap between the bases 4 of the feet 3.

The sides and ends of the feet 3 and the ends of the feet 1 are all shaped as isosceles trapezoids. The longitudinal edges of the pallet are formed with reinforcement in the shape of wooden slats 9 parallel to these edges and imbedded therein.

In addition the pallet is formed with a plurality of reinforcing ribs 5 extending parallel to its longitudinal direction, and with diagonal reinforcing ribs 6 extending inwardly at 45° angles from the corners. These reinforcing ribs 5 and 6 have cross-sectional areas which are a small fraction of the cross-sectional areas of the feet 1 or 3. In addition they have an overall height $h$ which is equal to approximately one-third of the overall height H of the pallet between the planes P and P′.

It will be understood that each of the elements described above, or two or more together, may also find a useful application in other types of structures differing from the types described above.

While the invention has been illustrated and described as embodied in a four-way pallet, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent is set forth in the appended claims:

1. A four-way pallet comprising a generally rectangular unitary plate having two pairs of opposite edges and two opposite faces, said plate being unitarily formed inwardly of each edge of one of said pairs with a row of three separate edge bosses projecting and tapering from one of said faces and spaced apart in a direction parallel to said edges of said one pair, said bosses constituting feet for said plate and defining a pair of parallel ways across said plate at said one face and inset from and perpendicular to said direction, said plate further being formed between and parallel to said rows with a row of two separate middle bosses projecting and tapering from said one face and each formed with apertures in line with said ways, said middle bosses being spaced apart in said direction and offset to said edge bosses, whereby tines of a lift fork can pass under said pallet standing on said bosses between said edge bosses and through said apertures of said middle bosses.

2. The pallet defined in claim 1, wherein said plate is of substantially uniform thickness at and between said bosses, said bosses having flat end portions lying in a common plane parallel to said one face, the apertures of each middle boss defining a passage therethrough extending parallel to said plate.

3. The pallet defined in claim 2, wherein said plate is elongated in the direction of said rows and is reinforced at said edges of said one pair.

4. The pallet defined in claim 3, wherein said plate is provided with a reinforcing element at each of said edges of said one pair.

5. The pallet defined in claim 4, wherein said reinforcing element is a wooden slat imbedded in said plate.

6. The pallet defined in claim 2, wherein said plate is formed between said bosses with a plurality of stiffening ribs extending parallel to said rows.

7. The pallet defined in claim 6, wherein said plate is formed with at least two diagonal stiffening ribs extending across said plate from the corners defined by said edges.

8. The pallet defined in claim 2, wherein said plate is molded wood chip material.

9. The pallet defined in claim 2, wherein each of said edge bosses has four sides formed as isosceles trapezoids.

10. The pallet defined in claim 1, wherein each of said bosses of each row has a length in said direction equal at most to a fraction of the length of said edges of said one pair in said direction.

* * * * *